US006612626B2

(12) United States Patent
O'Brien, II

(10) Patent No.: US 6,612,626 B2
(45) Date of Patent: Sep. 2, 2003

(54) EXIT DEVICE WITH A TENSION SUPPORT

(75) Inventor: James A. O'Brien, II, LaSalle, MI (US)

(73) Assignee: Ervos, Inc., Pittsburgh, PA (US)

( * ) Notice: Subject to any disclaimer, the term of this patent is extended or adjusted under 35 U.S.C. 154(b) by 0 days.

(21) Appl. No.: 10/127,791

(22) Filed: Apr. 22, 2002

(65) Prior Publication Data

US 2002/0153732 A1 Oct. 24, 2002

Related U.S. Application Data

(60) Provisional application No. 60/286,071, filed on Apr. 24, 2001.

(51) Int. Cl.[7] ..... E05B 65/10

(52) U.S. Cl. ..... 292/93; 292/DIG. 65; 292/92

(58) Field of Search ..... 292/92, 93, 336.3, 292/DIG. 65

(56) References Cited

U.S. PATENT DOCUMENTS 2,871,050 A * 1/1959 Dickinson ..... 292/336.3
3,024,053 A * 3/1962 Cox ..... 292/21
4,384,738 A * 5/1983 Floyd ..... 292/92
4,796,931 A * 1/1989 Heid ..... 292/92
4,824,150 A * 4/1989 Smith ..... 292/92
4,961,330 A * 10/1990 Evans ..... 292/21
5,016,927 A * 5/1991 Toledo ..... 292/92
5,169,185 A * 12/1992 Slaybaugh ..... 292/92
6,000,733 A * 12/1999 Linder ..... 292/92
6,145,897 A * 11/2000 Locher ..... 292/92

* cited by examiner

*Primary Examiner*—Gary Estremsky
(74) *Attorney, Agent, or Firm*—Paul A. Beck & Associates

(57) ABSTRACT

This invention provides a touch bar exit device on a door. The exit device has a touch bar assembly having two ends supported at one end by an active case attached to the door and an inactive case fastened to the door at the other end. There is a means for creating tension on the touch bar assembly between the two ends when a load is applied against the touch bar assembly. Alternatively, the means for creating tension on the touch bar assembly between the two ends can occur in the absence of a load applied to the touch bar assembly.

6 Claims, 6 Drawing Sheets

EXIT DEVICE WITH A TENSION SUPPORT

CROSS REFERENCE TO RELATED APPLICATION

This application claims the benefit of U.S. Provisional Application No. 60/286,071 filed on Apr. 24, 2001.

BACKGROUND OF THE INVENTION

1. Field of the Invention

This invention relates to touch bar exit devices for doors. Specifically, it concerns the rigidity of a touch bar assembly by means of tension support.

2. Description of the Related Art

Existing exit devices with touch bar assemblies depend upon the strength and configuration of materials to gain some degree of rigidity. The rigidity can be dependent upon thickness of materials used. It can also be dependent upon the shape of the materials used. For example tubular shape can provide some rigidity. The existing art is also aided in giving some rigidity by making the touch bar assembly of an existing device flush against a surface of a door.

Rigidity is in important to an exit device so that the device stays on the door and doesn't distort when it is hit with force for example by carts, gurneys, and fork trucks.

SUMMARY OF THE INVENTION

The purpose of this invention is to strengthen and make more solid the elongated touch bar assembly of an exit device. This is accomplished by introducing a piece called a draw bar which connects the back end of the touch bar assembly and an inactive case and creates a tension across the entire body of the touch bar assembly when a load is applied to the touch bar assembly or it can create tension across the touch bar assembly before a load is applied. When in tension the load is distributed along the length of the touch bar assembly. Being in a state of tension adds substantially to the solidity and strength of the touchbar assembly.

This new approach presented provides superior rigidity by means of placing the touch bar assembly in tension between two fixed members—an active case on a latchbolt side of a door and an inactive case on a hinge side of a door. To our knowledge, there is no prior art for a tension-type touch bar assembly.

This invention provides a touch bar exit device on a door. The exit device has a touch bar assembly having two ends supported at one end by an active case attached to the door and an inactive case fastened to the door at the other end. There is a means for creating tension on the touch bar assembly between to two ends when a load is applied against the touch bar assembly. Alternatively, the means for creating tension on the touch bar assembly between the two ends can occur in the absence of a load applied to the touch bar assembly. The means for creating tension can be a accomplished by having a dimple on the channel of the touch bar assembly. A draw bar having a slot engages the dimple of the touch bar assembly channel. The draw bar also has a back leg with a hole to receive a fastener. A faster can be inserted through a hole in the inactive case and also through the hole(s) of the back leg of the draw bar. The touch bar assembly is placed in tension when a load is applied. Alternatively, the touch bar assembly can be placed in tension when the fastener is tightened.

An end of the draw bar can abut a top inside wall of the touch bar assembly.

DETAILED DESCRIPTION OF THE INVENTION

Definitions

Figure 1:
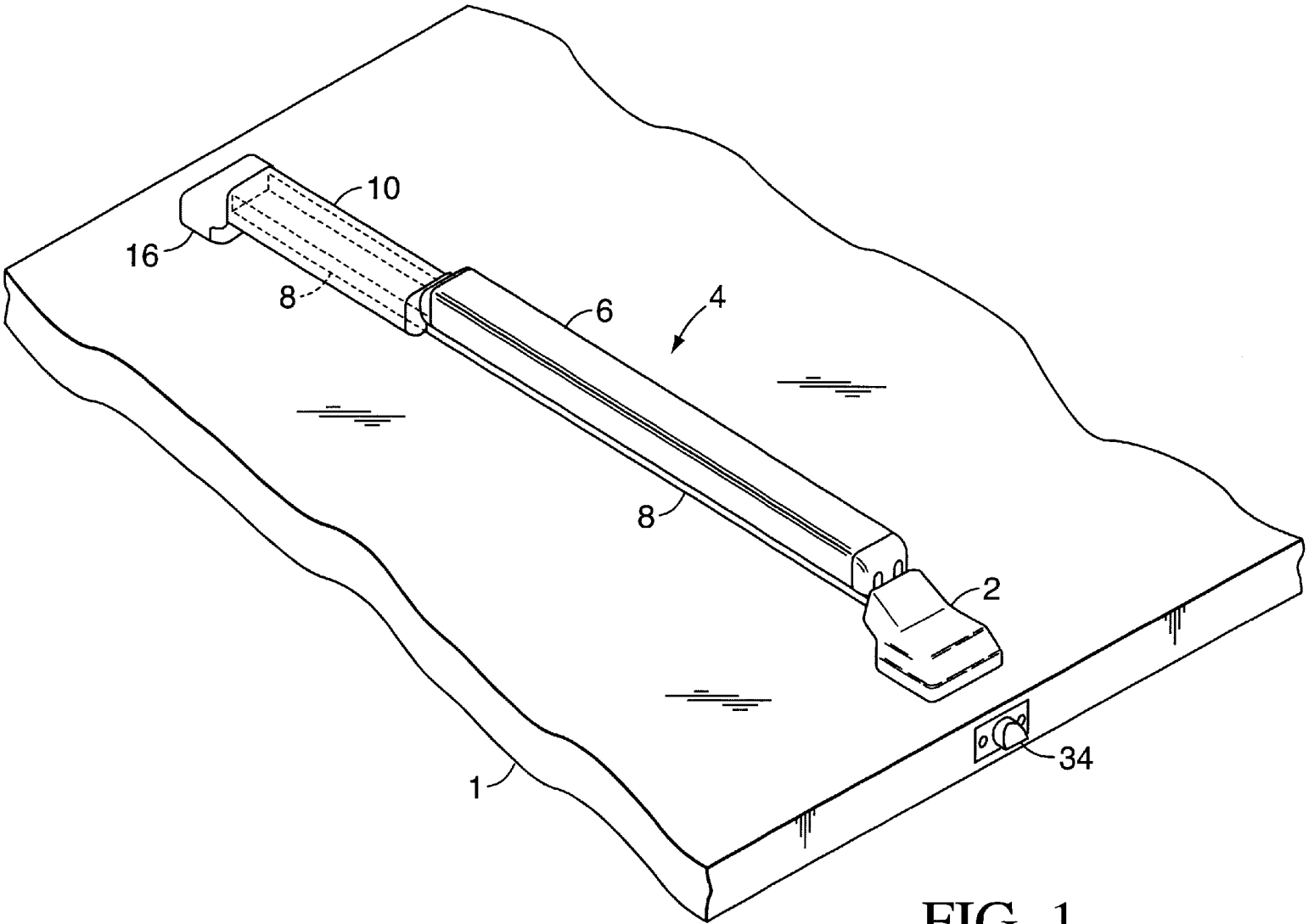
FIG. 1 An isometric view of a complete touch bar exit device on a door with a latchbolt assembly in the door.

"Touch Bar Exit Device" means a locking mechanism that consists of a touch bar assembly 4 on a push side of an exit door, interlinked with a latching mechanism that interfaces with a strike (or "keeper") mounted on the door frame. Pushing the touch bar 6 always retracts a latchbolt allowing the door to open. The activating touch bar 6 must span half the width of the door, from the latch side of the door to the middle of the door.

"Active Case" means a configured base of the active case 2 that is affixed to latching side of door by means of thru-bolts which fasten through the door to outside trim. The mechanics of the base interface with a latching assembly. The active case 2 also receives an end of the touch bar channel 8.

"Inactive Case" means a configured mounted plate affixed to a hinge side of a door. It is the means for holding the other end of the touch bar channel 8. The inactive case 16 consists of an inactive case base 18 and an inactive case cover 20.

"Touch Bar Assembly" includes a supporting touch bar channel 8, a spring-loaded touch bar 6 which is connected to the touch bar channel 8 by a pivot mechanism at both ends of the touch bar 6, and a filler plate tube 10 located behind the touch bar 6 and towards the hinge side of a door.

"Touch Bar Channel" means a channel that supports the touch bar assembly 4. It is attached to both an active case 2 and an inactive case 16. A spring loaded touch bar 6 glides downward along outside of the channel legs. The touch bar 6 is attached to the touch bar channel 8 by pivoting arms located at each end of the touch bar 6.

"Dimple" means a stamped protrusion along the bottom (web) of the touch bar channel 9 located towards the inactive case 16. The dimple 14 projections insert into a draw bar slot 24 of a draw bar.

"Draw Bar" means a configured metal piece that provides the means for placing the touch bar assembly 4 under tension. Its upper most part fits against the filler plate tube 10 segment of the touch bar assembly 4. A slot 28 in the draw bar engages a dimple 14 at the bottom of a touch bar channel 8. The lower part (back leg) has two oval holes for attaching to a door though an inactive case base 18 of the inactive case 16.

Figure 3:
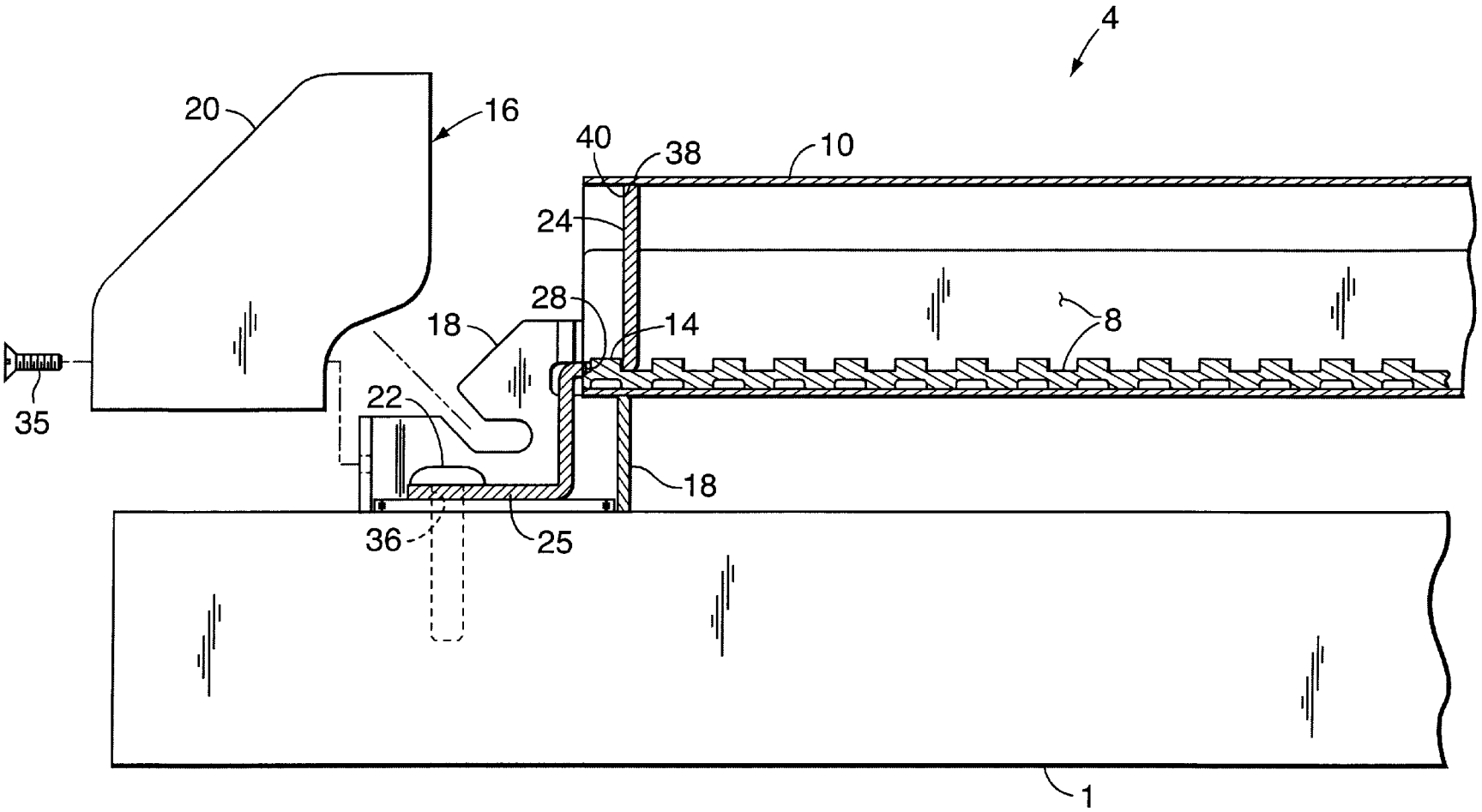
FIG. 3 A side view in partial section of an inactive case cover separated from an inactive case base.
Figure 4:
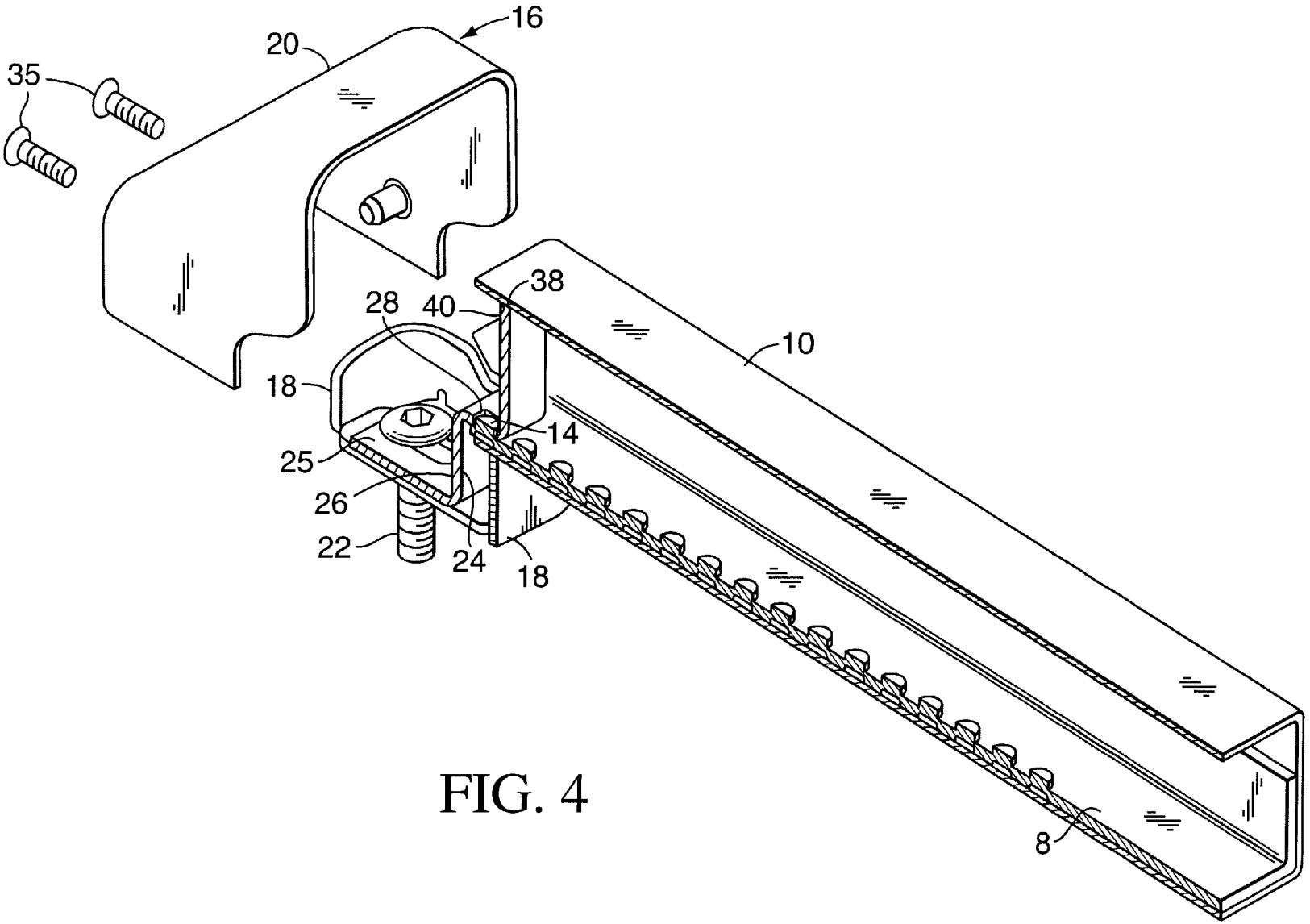
FIG. 4 An isometric view in partial section of an inactive case with inactive case cover separated from inactive case base and touch bar channel showing a draw bar positioned with a dimple and a fastener.
Figure 8:
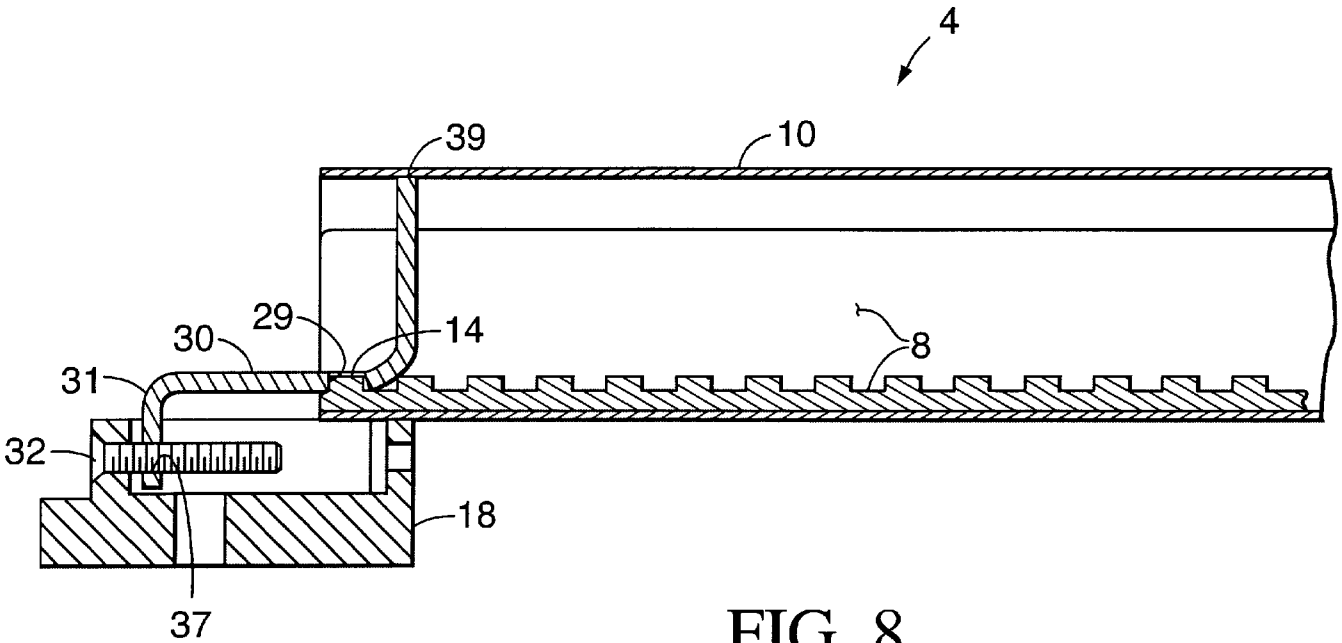
FIG. 8 A side view in section of an inactive case base showing an alternate draw bar.

"Means for creating tension" means placing the touch bar assembly 4 under tension in order to create greater rigidity in the touch bar assembly. The means for creating tension can be pretension stress as shown in FIG. 8 or potential tension when a load is applied to a touch bar assembly 4 as shown in FIGS. 3 and 4. The structure for the means for creating tension as shown in FIGS. 3 and 4 for the potential tension embodiment include a dimple 14 on the channel 8 of the touch bar assembly 4, a draw bar 24 having a slot 28 for engaging the dimple 14, the draw bar 24 having a back leg 25 with a hole 36 to receive a fastener 22, a fastener 22 is used to fasten the draw bat 24 and the inactive case base 18 to the door 1, and equivalents thereof of the means. The structure for the means for creating tension for the pretension stress embodiment as shown in FIG. 8 include a dimple 14 on the channel 8 of the touch bar assembly 4, a draw bar 30 having a slot 29 for engaging the dimple 14, the draw bar 30 having a back leg 31 with a hole 37 to receive a fastener 32, a fastener 32 inserted through a hole in the inactive case base 18 and through the hole 37 of the back leg 25 of the draw bar 24 and equivalents thereof of the means.

"Filler plate tube" means a tube at the back of the touch bar assembly 4 that fits over and is attached to the back of a touch bar channel 8 near the inactive case 16. The tube can be any geometrical shape and does not have to be round. For example it can be square or rectangular as shown in the examples.

"Touch Bar" means spring loaded activator bar on a push side of a door that activates a locking mechanism for retracting a latchbolt. It is attached at each end by pivot arms to touch bar channel.

"Fastener" means an attachment of an inactive case base 18 and a draw bar 24 to a door by a fastener 22 which can be a thru-bolt as shown in FIGS. 3 and 4. FIG. 8 shows a fastener 32 for an alternate draw bar and is a tension screw.

Description

Figure 2:
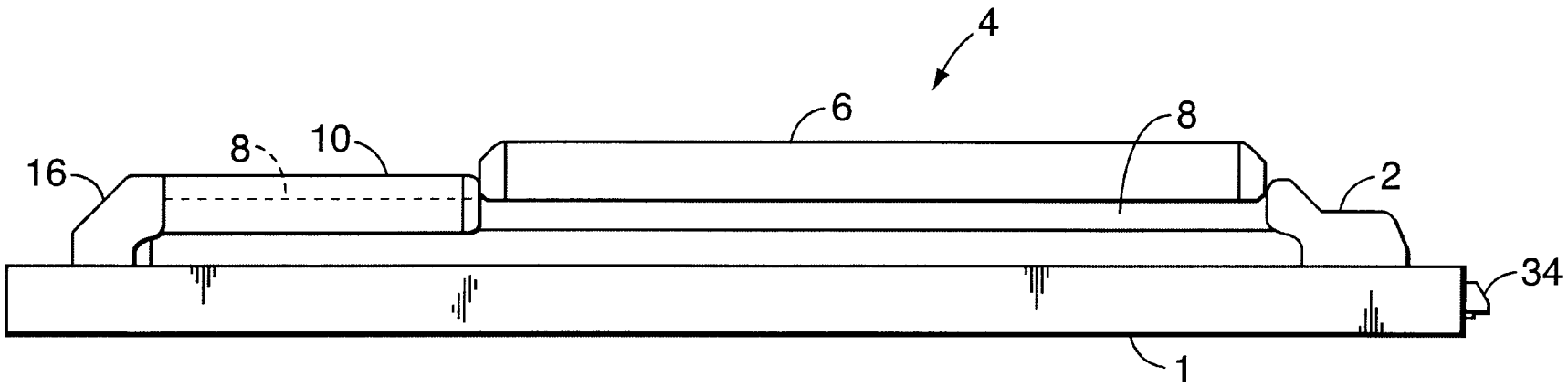
FIG. 2 A side view of a complete touch bar exit device on a door.

FIGS. 1 and 2 show a touch bar assembly 4 attached to a door 1. An active case 2 is attached to the door at a latch side of the door 1. An inactive case 16 is attached to a hinged side of the door 1. A touch bar channel 8 is connected at one end to the active case 2 and to the inactive case 16 at the other end. A filler plate tube 10 covers the back of the touch bar channel 8 near the inactive case 16. A touch bar 6 extends from the active case 2 and covers half of the door 1. When the touch bar 6 is depressed it operates a latch bolt 34 and allows the door 1 to open. The touch bar assembly 4 includes the touch bar channel 8, the touch bar 6, and the filler plate tube 10. The touch bar channel 8 supports the entire touch bar assembly 4.

FIG. 3 shows part of the touch bar assembly 4 when used with a draw bar 24. The inactive case 16 consists of an inactive case base 18 and an inactive case cover 20. A screw 35 connects the inactive case cover 20 to the inactive case base 18. The draw bar 24 has a slot 28 for receiving a dimple 14 at the base of the touch bar channel 8. An end 38 of the draw bar 24 abuts the top inside wall 40 of the filler plate tube 10. A back leg 25 of the draw bar 24 fits against the inactive case base 18 and has a hole(s) 36 which a fastner 22 is used to fasten the draw bar 24 and the inactive cover base 18 to the door 1. The fastner 22 can be a thru bolt or a sheet metal screw.

FIG. 4 is an isometric view in partial section of the inactive case 16, the touch bar channel 8 and the filler plate tube 10. The draw bar 24 is shown attached to inactive case base 18 by a fastner 22 at the back leg 25 of the draw bar 24. A slot 28 in the draw bar 24 receives a dimple 14 at the base of the touch bar channel 8. The end 38 of the draw bar 24 abuts the top inside wall 40 of the filler plate tube 10. When the draw bar 24 is in place and attached to the door 1 (not shown in FIG. 4) a draw bar low verticle 26 will act like a spring and minutely bow when a load is applied against the touch bar assembly 4 (not shown in its entirety in FIG. 4 but shown in FIGS. 1 & 2). This allows stress to be distributed along the entire touch bar assembly 4 (shown in FIGS. 1 & 2) when a load is applied. This embodiment provides potential tension support.

Figure 5:
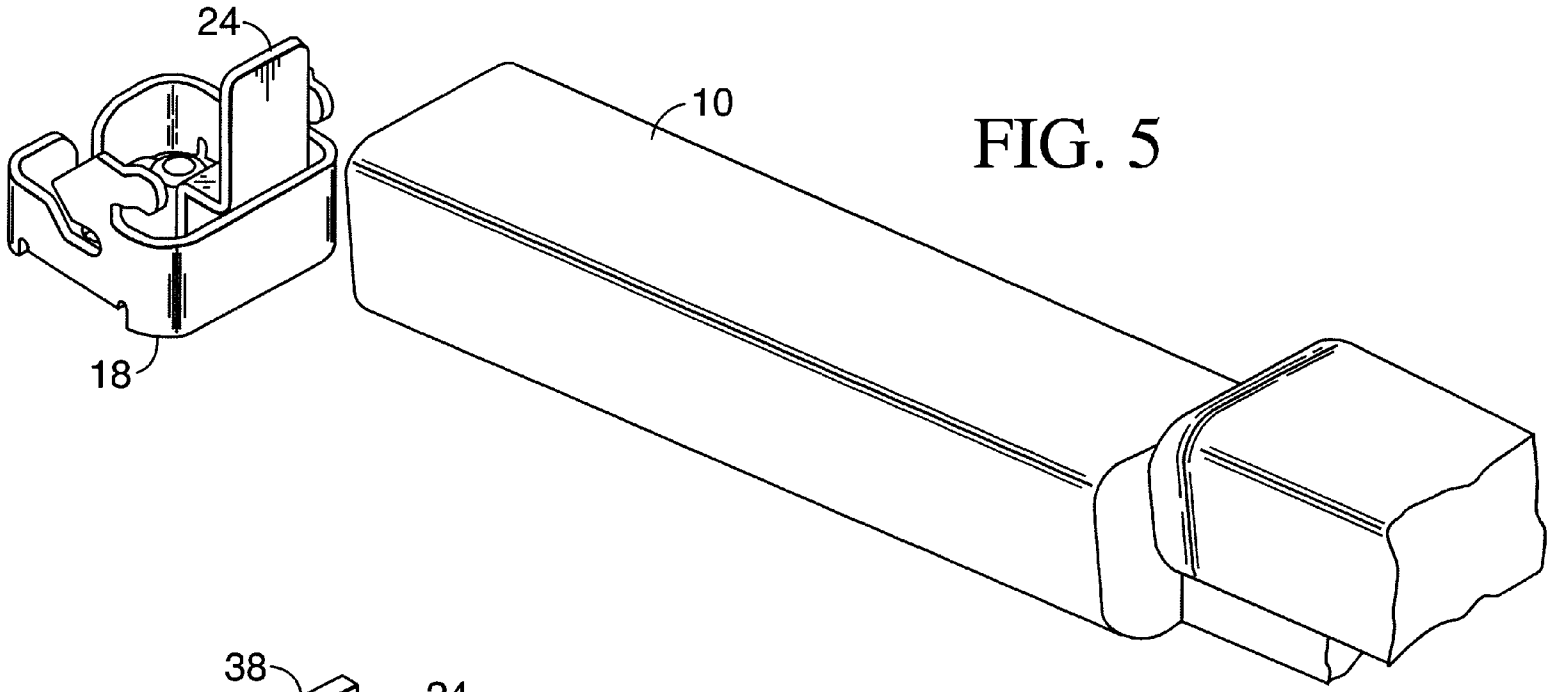
FIG. 5 An isometric view of an inactive case base with a draw bar and a filler plate tube which is separated from the inactive case.

FIG. 5 is an isometric view of the inactive case base 18 with the draw bar 24 and the filler plate tube 10. The case base 18 is shown separated from the filler plate tube 10.

Figure 6:
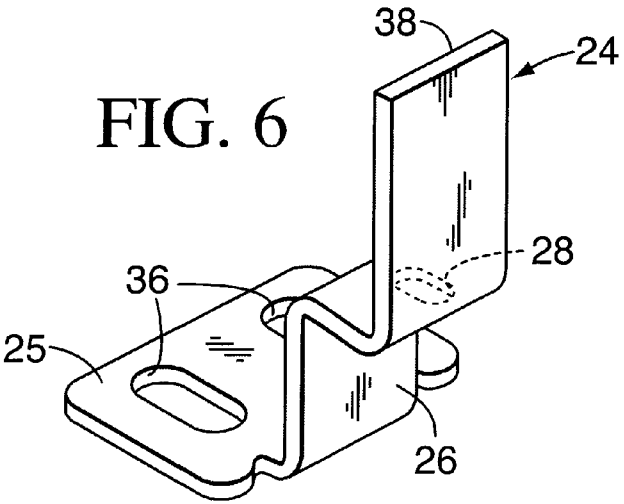
FIG. 6 An isometric view of a draw bar.

FIG. 6 is an isometric view of the draw bar 24. The draw bar 24 has a slot 28, a draw bar low vertical 26, and a back leg 25. The back leg 25 of the draw bar 24 can have two oval holes 36 to receive a door fastener 22 (not shown in FIG. 6). The draw bar 24 has an end 38.

Figure 7:
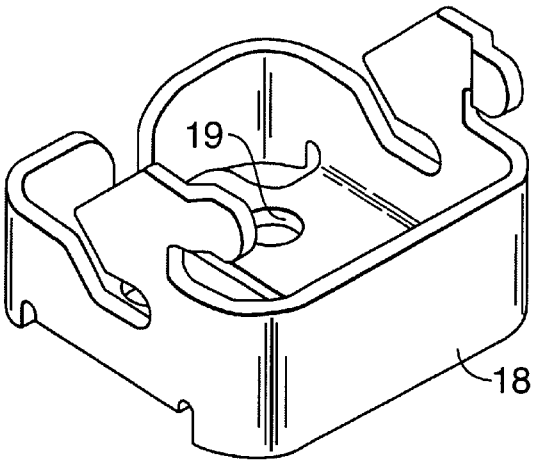
FIG. 7 An isometric view of an inactive case base.

FIG. 7 is an isometric view of the inactive case base 18. The inactive case base 18 has a hole(s) 19 to receive a fastener 22 (not shown in FIG. 7) to attach the inactive case base 18 to the door 1 (not shown in FIG. 7).

FIG. 8. shows an alternative embodiment of part of the touch bar assembly 4. An alternate draw bar 30 that has a draw bar slot 29 to receive a dimple 14 at the base of the touch bar channel 8. The alternative draw bar 30 has an end 39 that abuts a top inside wall 40 of the filler plate tube 10. A back leg 31 of the alternative draw bar 30 has a hole 37 to receive a fastener 32 that goes through an inactive case base 18. The fastener is a tension device that can be a tension screw. This embodiment provides for pre-tension support of the touch bar assembly 4.

Various changes could be made in the above construction and method without departing from the scope of the invention as defined in the claims below. It is intended that all matter contained in the above description as shown in the accompanying drawings shall be interpreted as illustrative and not as a limitation.

I claim:

1. A touch bar exit device on a door having:

(a) an active case fastened to the door;

(b) an inactive case fastened to the door;

(c) a touch bar assembly having two ends and supported at one end by the active case and at the other end by the inactive case; and (d) means for creating tension on the touch bar assembly between the two ends when a load is applied against the touch bar assembly.

2. A touch bar exit device as recited in claim 1 wherein the means creating tension comprises:

(a) a dimple on the touch bar assembly;

(b) a draw bar having a slot for engaging the dimple, the draw bar having a back leg with a hole to receive a fastener; and (c) a fastener inserted through a bole in the inactive case and through the hole of the back leg of the draw bar.

3. A touch bar exit device as recited in claim 2 wherein the draw bar has an end that abuts a top inside wall of the touch bar assembly.

4. A touch bar exit device on a door having:

(a) an active case fastened to the door;

(b) an inactive case fastened to the door;

(c) a touch bar assembly having two ends and supported at one end by the active case and at the other end by the inactive case; and (d) means for creating tension on the touch bar assembly between the two ends, in the absence of a load applied to the touch bar assembly.

5. A touch bar exit device as recited in claim 4 wherein the means creating tension comprises:

(a) a dimple on the touch bar assembly;

(b) a draw bar having a slot for engaging the dimple, the draw bar having a back leg with a hole to receive a fastener; and (c) a fastener inserted trough a hole in the inactive case and through the hole of the back leg of the draw bar thereby, when the fastener is tightened, the touch bar assembly is placed in tension.

6. A touch bar exit device as recited in claim 5 wherein the draw bar has an end that abuts a top inside wall of the touch bar assembly.

* * * * *